US007311206B1

(12) United States Patent
Svensson et al.

(10) Patent No.: US 7,311,206 B1
(45) Date of Patent: Dec. 25, 2007

(54) QUATERNARY AMMONIUM COMPOUNDS FOR FROTH FLOTATION OF SILICATES FROM AN IRON ORE

(75) Inventors: Magnus Svensson, Stora Höga (SE); Jan Olof Gustafsson, Kungålv (SE); Anders Klingberg, Henån (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/959,038

(22) PCT Filed: Apr. 16, 2000

(86) PCT No.: PCT/SE00/00678

§ 371 (c)(1),
(2), (4) Date: Nov. 28, 2001

(87) PCT Pub. No.: WO00/62937

PCT Pub. Date: Oct. 26, 2000

(30) Foreign Application Priority Data

Apr. 20, 1999 (SE) ..... 9901398

(51) Int. Cl.
*B03D 1/01* (2006.01)
*B03D 1/02* (2006.01)
*B03D 1/06* (2006.01)

(52) U.S. Cl. ..... 209/166; 252/61

(58) Field of Classification Search ..... 209/166, 209/167; 252/61
See application file for complete search history.

(56) References Cited

U.S. PATENT DOCUMENTS

| | | | | |
|---|---|---|---|---|
| 2,341,046 A | | 2/1944 | Kirby | 209/166 |
| 2,410,021 A | * | 10/1946 | DeVaney | |
| 3,363,758 A | * | 1/1968 | Cronberg | |
| 3,960,715 A | | 6/1976 | Dicks et al. | 209/166 |
| 4,830,739 A | * | 5/1989 | Hellsten et al. | 209/166 |
| 4,892,649 A | * | 1/1990 | Mehaffey et al. | |
| 4,995,998 A | | 2/1991 | von Rybinski et al. | 252/61 |
| 5,720,873 A | * | 2/1998 | Klingberg et al. | 209/166 |

FOREIGN PATENT DOCUMENTS

| | | | |
|---|---|---|---|
| AU | 708335 | | 8/1997 |
| CA | 1100239 | * | 4/1981 |
| CA | 1 187 212 | | 5/1985 |
| WO | WO 94/26419 | | 11/1994 |
| WO | WO 97/26995 | | 7/1997 |

OTHER PUBLICATIONS

Derwent Abstract No. 004314512 Abstracting CA 1 187 212, May 1985.
J.A.O.C.S. 47 (1970); 5 Pgs. 177-179; Cationic Floatation of Silica From Magnetic Iron-Ore Concentrates. Hedberg.
International Search Report -Jul. 26, 2000 for PCT/SE00/00678.

* cited by examiner

*Primary Examiner*—Thomas M. Lithgow
(74) *Attorney, Agent, or Firm*—Ralph J. Mancini; Michelle J. Burke

(57) ABSTRACT

The present invention relates to a froth flotation process in which silicates are separated from an iron ore in the presence of a collector containing a quaternary ammonium compound having the formula $R_1R_1N^+R_3R_4$ 1/z $X^{z-}$ (I), in which the groups $R_1$ independently are hydrocarbon groups, preferably aliphatic groups containing 6-14 carbon atoms and/or the group $R_2$—$(OR_7)_m$—$OR_8$—, where the groups $R_2$ independently are acyl groups containing 6-14 carbon atoms, the groups $R_7$ independently are alkylene groups containing 2-4 carbon atoms, the groups $R_8$ independently are alkylene groups containing 2-3 carbon atoms and m is a number from 0-5, $R_3$ and $R_4$ independently are alkyl groups containing 1-4 carbon atoms or groups $(R_5O)_pH$, where the groups $R_5$ independently are alkylene groups having 2-4 carbon atoms and p is a number from 1-4, X is an anionic group, and z is the charge of the anion X. This collector has a high selectivity to concentrate silicates in the froth product, while a high yield of iron minerals is maintained in the bottom concentrate or concentrates.

9 Claims, No Drawings

QUATERNARY AMMONIUM COMPOUNDS FOR FROTH FLOTATION OF SILICATES FROM AN IRON ORE

The present invention relates to a froth flotation process in which silicates are separated from an iron ore in the presence of a collector containing a quaternary ammonium compound having two aliphatic groups and/or acyl groups containing 6-14 carbon atoms. This collector has a high selectivity to concentrate silicates in the froth product, while a high yield of iron minerals is maintained in the bottom concentrate or concentrates.

Quaternary ammonium compounds are often utilised as collectors in froth flotation processes. Thus, it is described in WO 94/26419 to subject a calcite mineral to a froth flotation process in the presence of a mixture containing a quaternary compound and an alkylene oxide adduct of an alkylamine, as a collector component. WO 97/26995 describes the use of esterquats as flotation agent for nonsulphidic minerals. The quaternary ammonium compounds contain acyl groups of 6-24 carbon atoms. In the working examples esterquats of not defined nature, dicocoalkyl dimethyl ammonium chloride or trimethyl tallow ammonium chloride are used as collectors for silicate-rich calcite ores with enhanced content of magnesium. U.S. Pat. No. 3,960,715 relates to a froth flotation process for separating siliceous gangue constituents from an iron ore performed in the presence of a cationic collector including quaternary amines, such as dodecyl trimethyl ammonium chloride.

The article "Cationic Flotation of Silica From Magnetic Iron-Ore Concentrates": H. C. Hedberg, MAOCS, U7 (1970: 5, 177-179), compares the effect of different cationic collectors. The tests show that the quaternary ammonium compounds, trimethyl coco ammonium chloride, trimethyl lauryl ammonium chloride and trimethyl tallow ammonium chloride were not as efficient as coco primary amine acetate used as a standard.

The U.S. Pat. No. 4,995,998 discloses the use of fatty alcohol polyglycol ethers terminally blocked by hydrophobic radicals as co-collectors together with cationic or ampholytic surfactants in the flotation of non-sulfidic ores. In Example 4, pure quartz sand is subjected to a froth flotation process in the presence of a lauryl trimethyl ammonium chloride.

Although these flotation processes have positive effects, there is a clear tendency that the enriched iron mineral either contains a too high silicate level (often essentially over 1% by weight) or a too low iron yield. Therefore, the main objective of the present invention is to develop a more selective froth flotation process resulting in a high yield of iron at a low silicate content. Another objective of the invention is to obtain the improved flotation at a low dosage of the collector.

According to the present invention it has been found that these objectives can be achieved by carrying out a reversed forth flotation process at a pH of 7-11 of an aqueous suspension of a silicate-containing iron ore in the presence of a depressing agent of the iron mineral and a quaternary ammonium compound having the formula $R_1R_1N^+R_3R_4$ 1/z $X^{z-}$ (I), in which the groups $R_1$ independently are hydrocarbon groups, preferably aliphatic groups containing 6-14 carbon atoms and/or the group $R_2$—$(OR_7)_m$—$OR_8$—, where the groups $R_2$ independently are acyl groups containing 6-14 carbon atoms, the groups $R_7$ independently are alkylene groups containing 2-4 carbon atoms, the groups $R_8$ independently are alkylene groups containing 2-3 carbon atoms and m is a number from 0-5, $R_3$ and $R_4$ independently are alkyl groups containing 1-4 carbon atoms or groups $(R_5O)_p$ H, where the groups $R_5$ independently are alkylene groups having 2-4 carbon atoms and p is a number from 1-4, X is an anionic group, and z is the charge of the anion X, the amount of the quaternary ammonium compound being 10-500 milligram per kg iron ore.

Preferably the groups $R_1$ are straight aliphatic groups containing 6-10 carbon atoms or branched aliphatic groups containing 8-13 carbon atoms and the groups $R_2$ are straight acyl groups containing 6-10 carbon atoms or branched acyl groups containing 8-13 carbon atoms.

These quaternary ammonium compounds having two comparatively small aliphatic groups and/or acyl groups exhibit even at low dosages an unexpected high selectivity for silicates and leave an iron-containing concentrate of high purity and a very low content of silicates. The quaternary ammonium compounds are preferably added in an amount of 15-200 milligram per kg iron ore, and most preferably in an amount of 15-100 milligram per kg iron ore.

Since the froth product from the rougher flotation may contain considerable amounts of iron minerals, the froth product may be subjected to one or more, for example from 1 to 5, additional froth flotation steps (cleaning steps) after adding water and if desired, a complementary addition of the quaternary ammonium compound, the depressing agent and/or other flotation chemicals. Normally, it is not necessary to make any supplementary addition of the collector. The bottom concentrate from the rougher flotation and the bottom concentrates from the subsequent froth flotation steps of the froth products are suitably combined to a final concentrate having high yield of iron and a very low content of silicates.

Preferred quaternary ammonium compounds are those, where the groups $R_5$, $R_7$ and $R_8$ are the —$C_2H_4$— group and at least one of the groups $R_3$ and $R_4$ is an alkyl group, preferably the methyl group. These compounds are easy to produce and have excellent properties. The groups $R_1$ are preferably n-octyl, n-decyl, 2-propylheptyl and/or methyl substituted alkyl groups having 9-13 carbon atoms. The groups $R_2$ are preferably 2-ethylhexanoyl, n-octanoyl, 2-propylheptanoyl and methyl-substituted acyl groups containing 9-13 carbon atoms. The anionic group X is suitably a halogenide, such as chloride; an alkyl sulphate, such as methyl sulphate; hydrogen sulphate; or a carboxylate, such as acetate. The quaternary ammonium compounds used in the flotation process are well known and there exists a comprehensive literature disclosing the methods of their preparation.

In the flotation process according to the invention, the iron ore can be ground together with water to the desired particle size. As a rule, at least 50% by weight of the ground ore has a particle size between 5 and 200 μm. The ground ore is then suspended in water, and fine material is deslimed in conventional manner, for instance, by screening, settling or cycloning. Thereafter, an aqueous water slurry (pulp) is prepared from the deslimed ore and a depressing agent for the iron ore is normally added. The depressing agent could be a hydrophilic polysaccharide, e.g. starch, such as corn starch activated by treatment with alkali and dextrin. Other examples of suitable hydrophilic polysaccharides are cellulose derivatives, such as carboxymethyl cellulose, sulphomethyl cellulose, methyl cellulose, hydroxyethyl cellulose and ethyl hydroxyethyl cellulose; hydrophilic gums, such as gum arabic, gum karaya, gum tragacanth and gum ghatti; alginates; and starch derivatives, such as carboxymethyl starch and phosphate starch. The depressing agent is normally added in an amount of about 10 to about 1000 g per tonne of ore. Besides, alkali is usually added in an amount sufficient to obtain a pH of 7-11, preferably 9-11. After conditioning of the pulp, the quaternary ammonium compounds can be added and the mixture is further conditioned for a while before the froth flotation is carried out. If desired, froth-regulating means can be added on a convenient occasion before the froth flotation. Examples of suitable froth-regulating additives are methyl isobutyl carbinol and alcohols having 6-12 carbon atoms which optionally are alkoxylated with ethylene oxide and/or propylene oxide.

The Examples below further illustrate the present invention.

EXAMPLE 1

A hematite ore containing about 13.1% by weight of $SiO_2$ an about 85.9% by weight $Fe_2O_3$ was ground to such a particle size that 45.4% by weight passed a screen having a mesh opening of 32 μm. Then the ore was suspended in water and deslimed by a hydrocyclone, and an aqueous pulp of the deslimed ore was prepared with a dry content of 60%. After addition of 500 mg of starch treated with alkali per kg ore the pulp was conditioned for 5 minutes. The concentration of ore in the pulp was then reduced by addition of water to 40%, the pH-value of the pulp adjusted to 10.5 and a collector added in the amounts stated in table 2. The whole mixture was then conditioned for 60 seconds followed by rougher flotation, whereby a silicate-rich froth product and an iron-rich bottom concentrate were obtained. The froth product was cleaned by means of a second flotation step (cleaning step) without any additions of collectors or other additives and the bottom concentrate from the cleaning step was added to the bottom concentrate from the rougher flotation. This cleaning process was repeated one or three times and the bottom concentrate from the rougher flotation and the bottom concentrates from the different cleaning steps were combined. The bottom concentrate from the rougher flotation and the different combined bottom concentrates were analysed with respect to the yield of iron ($Fe_2O_3$) and the content of silicate ($SiO_2$). The results are shown in table 2 below.

TABLE 1

| Collectors | |
|---|---|
| Designation Symbol | Structure |
| A | $C_8$-$C_{10}$-alkyl-O—$C_3H_6$ $NH_2$ |
| B | Coco fatty alkyl $(CH_3)_3$ $N^+$ $Cl^-$ |
| 1 | (n-octyl)$_2$ $(CH_3)_2$ $N^+$ $Cl^-$ |
| 2 | (2-ethylhexyl-$OC_2H_4)_2$ $(CH_3)_2$ $N^+$ $Cl^-$ |
| 3 | 20% (n-octyl)$_2$ $(CH_3)_2$ $N^+$ $Cl^-$<br>80% (n-decyl)$_2$ $(CH_3)_2$ $N^+$ $Cl^-$ |

From the results it is evident that the collectors according to the invention have a strong affinity and high selectivity for silicates. By repeated cleaning of the froth product it is also possible to obtain a combination of the bottom concentrates with an excellent yield of $Fe_2O_3$ and a very low content of $SiO_2$ in comparison with the prior art. Furthermore, the amounts of the collectors needed to perform the froth flotation process are astonishingly low.

EXAMPLE 2

An hematite ore containing 24.1% by weight of $SiO_2$ and about 73.6% by weight $Fe_2O_3$ was ground to such a particle size that 27.2% by weight passed a screen having a mesh opening of 32 μm. An aqueous suspension of the material ground was then prepared in the same manner as in Example 1. The iron ore suspensions were subjected to rougher flotations, which were followed by one or more cleaning steps of the froth products. In the cleaning processes no supplementary addition of flotation chemicals was made. The bottom concentrate from the rougher flotation and the different combined bottom concentrates were analysed with respect to the total yield of iron ($Fe_2O_3$) and the content of silicate ($SiO_2$). The results obtained are shown in Table 4 below.

TABLE 3

| Collectors | |
|---|---|
| Symbol | Structure |
| A | See Example 1 |
| B | See Example 1 |
| C | Tallow fatty alkyl $(CH_3)_3N^+Cl^-$ |
| 1 | See Example 1 |
| 2 | See Example 1 |
| 3 | 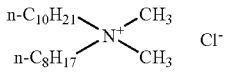 |
| 4 | (methyl branched $C_{11}$-alkyl)$_2$$(CH_3)_2N^+Cl^-$ |
| 5 | (methyl branched $C_{12}$-$C_{13}$-alkyl)$_2$$(CH_3)_2N^+Cl^-$ |
| 6 | (coco fatty alkyl)$_2$$(CH_2)_2N^+Cl^-$ |

TABLE 2

| Flotation results | | | | | | | | | | | |
|---|---|---|---|---|---|---|---|---|---|---|---|
| Coll | Add. mg/kg | Bottom concentrates | | | | | | | | | |
| Symbol | ore | Yield $Fe_2O_3$, % | | | | | Content $SiO_2$, % | | | | |
| A | 30 | 90.8 | 98.0 | 99.7 | — | — | 0.79 | 2.02 | 4.85 | — | — |
| B | 60 | 69.0 | 81.1 | 87.6 | — | — | 1.11 | 2.65 | 4.85 | — | — |
| 1 | 20 | 81.4 | 91.3 | 94.2 | 96.7 | 98.2 | 0.59 | 0.68 | 0.77 | 0.88 | 1.12 |
| 1 | 25 | 75.0 | 87.9 | 92.8 | 95.3 | 97.3 | 0.49 | 0.53 | 0.55 | 0.59 | 0.69 |
| 2 | 30 | 78.4 | 89.5 | 93.9 | 96.0 | 97.7 | 0.59 | 0.62 | 0.66 | 0.71 | 0.82 |
| 3 | 45 | 79.4 | 90.6 | 94.9 | — | — | 0.54 | 0.66 | 0.80 | — | — |

TABLE 4

| Coll | Add. mg/kg | Flotation results | | | | | | | | | |
|---|---|---|---|---|---|---|---|---|---|---|---|
| | | Bottom concentrates | | | | | | | | | |
| Symbol | ore | Yield $Fe_2O_3$, % | | | | | Content $SiO_2$, % | | | | |
| A | 100 | 86.3 | 96.3 | 98.8 | — | — | 1.2 | 2.3 | 4.1 | — | — |
| B | 200 | 77.7 | 91.1 | — | — | — | 24.1 | 24.8 | — | — | — |
| C | 200 | 74.7 | 89.0 | — | — | — | 1.2 | 1.3 | — | — | — |
| C | 100 | 82.1 | 94.4 | — | — | — | 8.2 | 10.2 | — | — | — |
| 1 | 45 | 84.4 | 93.6 | 96.4 | 97.7 | 98.4 | 0.91 | 1.01 | 1.12 | 1.23 | 1.4 |
| 1 | 60 | 81.5 | 91.4 | 94.9 | — | — | 0.88 | 0.96 | 1.06 | — | — |
| 2 | 45 | 86.8 | 94.8 | 97.3 | — | — | 0.98 | 1.08 | 1.18 | — | — |
| 2 | 60 | 83.1 | 92.2 | 95.3 | — | — | 0.87 | 0.97 | 1.07 | — | — |
| 3 | 60 | 86.1 | 94.8 | — | — | — | 0.97 | 1.2 | — | — | — |
| 4 | 60 | 89.3 | 96.8 | — | — | — | 1.02 | 1.4 | — | — | — |
| 5 | 100 | 92.7 | 98.6 | — | — | — | 0.85 | 1.3 | — | — | — |
| 6 | 150 | 92.4 | 98.5 | — | — | — | 0.98 | 1.5 | — | — | — |

The flotation results are similar to the results in Example 1. The collectors according to the invention have a strong affinity and selectivity for silicates already at a low dosage, especially the collectors having short chain aliphatic or acyl groups.

The invention claimed is:

1. A process for enriching an iron mineral from a silicate-rich iron ore by performing a reversed froth flotation of an aqueous suspension of the iron ore at a pH of 7-11 in the presence of a collector comprising at least one quaternary ammonium compound and a depressing agent for the iron mineral, wherein the collector comprises at least one quaternary ammonium compound having the formula $$R_1R_1N^+R_3R_4\ 1/z\ X^{z-} \quad \text{(I)},$$

in which the groups $R_1$ can be the same or different and are independently selected from aliphatic groups containing 6-14 carbon atoms, or the group $R_2$—$(OR_7)_m$—$OR_8$—, where the groups $R_2$ independently are acyl groups containing 6-14 carbon atoms, the groups $R_7$ independently are alkylene groups containing 2-4 carbon atoms, the groups $R_8$ independently are alkylene groups containing 2-3 carbon atoms and m is a number from 0-5, $R_3$ and $R_4$ independently are alkyl groups containing 1-4 carbon atoms, X is an anionic group, and z is the charge of the anion X, the amount of the quaternary ammonium compounds being 10-500 milligram per kg iron ore.

2. Process according to claim 1, wherein the groups $R_1$ are the same or different and are independently selected from straight, aliphatic groups containing 6-10 carbon atoms, branched aliphatic groups containing 8-13 carbon atoms, or the group $R_2$—$(OR_7)_m$—$OR_8$—, where $R_7$, $R_8$ and m have the meaning mentioned in claim 1 and the groups $R_2$ independently are straight, acyl groups containing 6-10 carbon atoms or branched acyl groups containing 8-13 carbon atoms.

3. Process according to claim 2 wherein $R_5$, $R_7$ and $R_8$ are the group —$C_2H_4$— and at least one of the groups $R_3$ and $R_4$ is an alkyl group.

4. Process according to claim 1 wherein the quaternary ammonium compound is present in an amount of 15-200 milligram per kilo iron ore.

5. Process according to claim 1 wherein the groups $R_1$ are the same or different and are independently selected from n-octyl, n-decyl, 2-propylheptyl and methyl-substituted alkyl groups containing 9-13 carbon atoms.

6. Process according to claim 2 wherein the groups $R_2$ are independently selected from 2-ethylhexanoyl, n-octanoyl, 2-propylheptanoyl or methyl-substituted acyl groups containing 9-13 carbon atoms.

7. Process according to claim 1 wherein a hydrophilic polysaccharide is added to the aqueous suspension as said depressing agent for the iron mineral before the addition of the quaternary ammonium compound.

8. Process according to claim 7 wherein the froth product obtained from the flotation of the aqueous suspension of the iron ore is subjected to at least one additional froth flotation process.

9. The process of claim 1 wherein the groups $R_1$ are the same or different and are independently selected from aliphatic groups containing 6-14 carbon atoms.

* * * * *

UNITED STATES PATENT AND TRADEMARK OFFICE

CERTIFICATE OF CORRECTION

PATENT NO. : 7,311,206 B1
APPLICATION NO. : 09/959038
DATED : December 25, 2007
INVENTOR(S) : Magnus Svensson, Jan Olof Gustafsson and Anders Klingberg It is certified that error appears in the above-identified patent and that said Letters Patent is hereby corrected as shown below:

Cover page item (22) PCT Filed, change "April 16, 2000" to --April 10, 2000--.

Signed and Sealed this

Fifteenth Day of June, 2010

David J. Kappos

David J. Kappos
*Director of the United States Patent and Trademark Office*